United States Patent [19]

Pinto

[11] 4,455,825

[45] Jun. 26, 1984

[54] MAXIMIZED THERMAL EFFICIENCY HOT GAS ENGINE

[76] Inventor: Adolf P. Pinto, 3209 Dalemead St., Torrance, Calif. 90505

[21] Appl. No.: 459,221

[22] Filed: Mar. 1, 1983

[51] Int. Cl.[3] ..... F02G 1/04

[52] U.S. Cl. ..... 60/517; 60/682

[58] Field of Search ..... 60/516, 517, 518, 525, 60/650, 682

[56] References Cited

U.S. PATENT DOCUMENTS

| | | | |
|---|---|---|---|
| 1,926,463 | 9/1933 | Stoddard | 60/650 X |
| 3,579,980 | 5/1971 | Kelly | 60/525 |
| 4,136,523 | 1/1979 | Pronovost | 60/517 |

*Primary Examiner*—Stephen F. Husar

[57] ABSTRACT

An improved closed cycle hot gas engine in which virtually the entire working gas mass performs the same Ericsson Cycle loop thereby achieving maximized thermal efficiency. The invention engine embodiments consist of paired cylinders connected together by leak sealed means for controlled working gas operation. The working gas is simultaneously heated and expanded in the heating cylinder and then simultaneously cooled and compressed in the cooling cylinder to achieve the isothermal expansion and compression steps respectively of the four step Ericsson Cycle loop. The improvements consist of means to provide both the reciprocating operation of the cylinders pistons as well as control of piston relative motion with respect to each other. Piston relative motion is such that during the entire simultaneous expansion and heating step virtually all the working gas is contained in the heating cylinder, and, during the entire simultaneous compression and cooling step virtually all the working gas mass is contained in the cooling cylinder. In between these two isothermal steps the gas mass is isobarically transferred between the cylinders by the storage or recovery, respectively, of working gas heat in a state-of-the-art regenerator located serially in the flow path between the heating and cooling cylinders.

6 Claims, 6 Drawing Figures

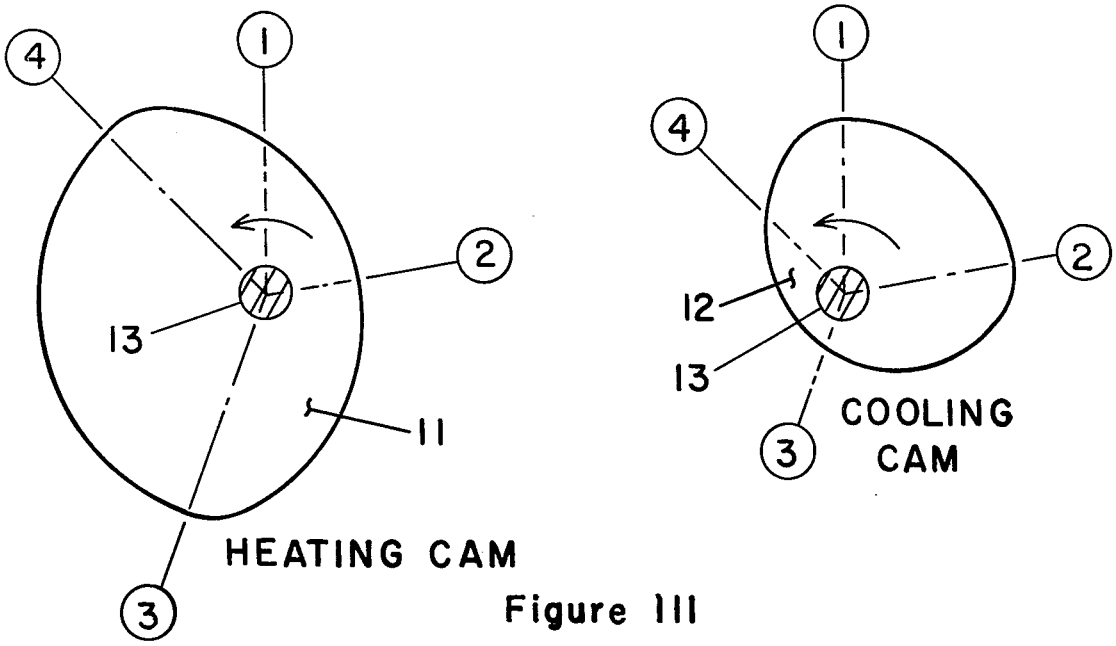
Figure III
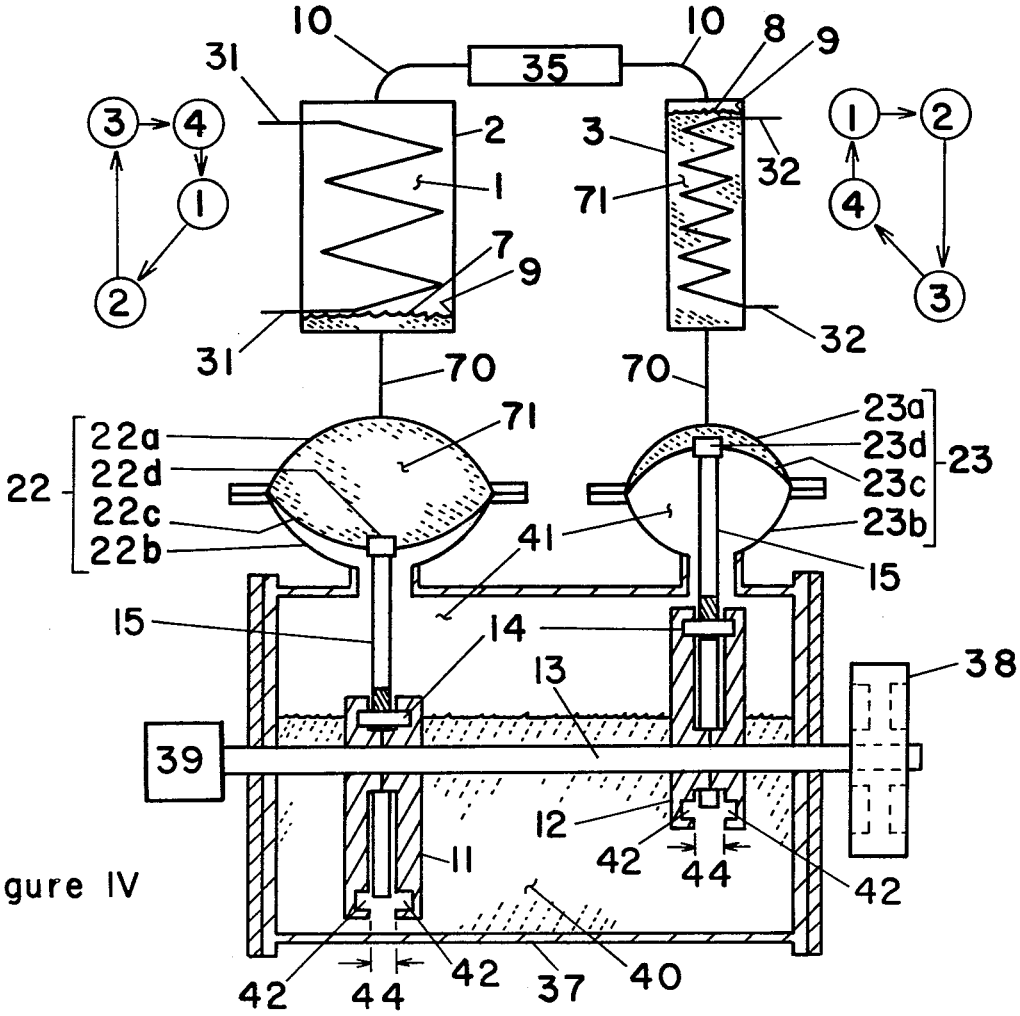
Figure IV

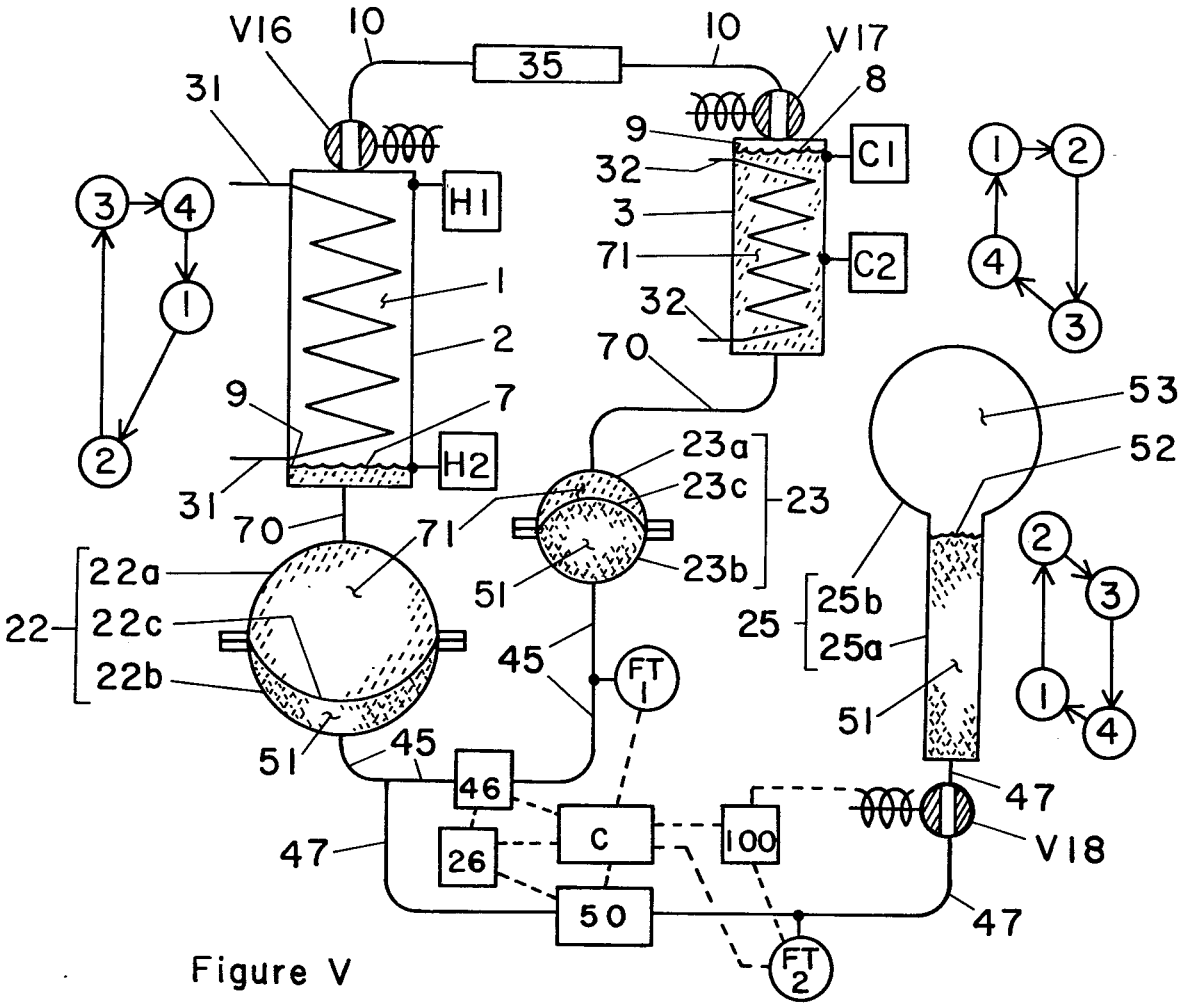
Figure V
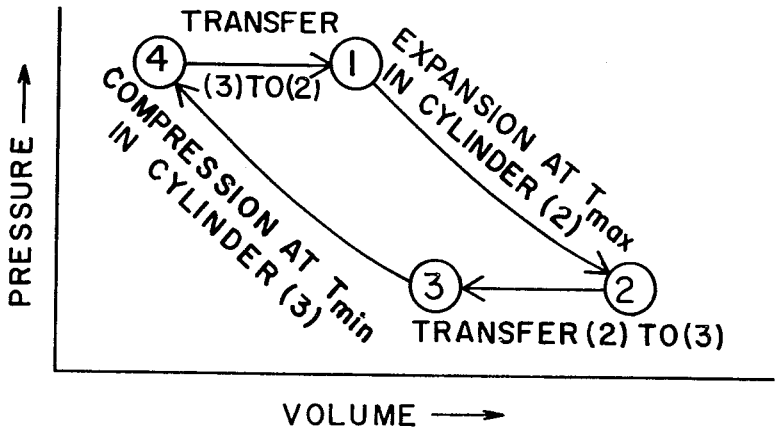
Figure VI

MAXIMIZED THERMAL EFFICIENCY HOT GAS ENGINE

BACKGROUND OF THE INVENTION

1. Field of the Invention

This invention pertains to closed cycle hot gas engines operating on the Ericsson Cycle. Operation of the working gas inside either cylinder and working gas transfer between cylinders is effected by pistons, whose motion is controlled by specially shaped cams mounted on a commonly driven shaft. Alternatively, operation and transfer of the working gas in another embodiment are controlled by valving members that are liquid piston level synchronized to operate with expansion and compression steps of the Ericsson cycle. In all the embodiments of the invention isobaric working gas transfer form one cylinder to the other in between the isothermal expansion and compression steps is insured by having the heating and cooling cylinder volumes in the same ratio as the absolute temperature of their respective isothermal processes.

In order to discuss the invention engine it is necessary first to consider prior state of the art hot gas engine development. Hot gas engines operating on either the Stirling (isochoric) or Ericsson (isobaric) cycles, with heat regeneration, are potentially capable of achieving Carnot efficiency, i.e., the maximum thermal efficiency achievable. This promise of maximized fuel economy, combined with broadening of heat sources that can be utilized in these engines and the relatively pollution free operation, as compared with Otto and Diesel internal combustion engines has resulted in much work being done on embodiments which attempt to mechanize the Stirling and Ericsson cycles. Both literature as well as various patents abound with examples including:

Rhythmic expansion and compression of working fluid hot gas engine foreign patents issued to N. V. Phillips, "Hot Gas Engines and Refrigeration Engines and Heat Pumps Operating on the Reversed Hot Gas Engine Principle," British Pat. No. 694, 856, dated 29 July 1953, and "Thermodynamic Reciprocating Machine," British Pat. No. 1,064,733, dated 5 Apr. 1967. Various other U.S. Patents including; W. A. Ross, "Stirling Engine Processes," U.S. Pat. No. 3,845, 624, dated 5 Nov. 1972, J. Koenig, "Hot-Air Engine," U.S. Pat. No. 1,614,962, dated 18 Jan. 1927, D. A. Kelly, "Composite Thermal Transfer System for Closed Cycle Engines." U.S. Pat. No. 3,635,017, dated 18 Jan. 1972 and "Uniflow Stirling Engine and Frictional Heating System," U.S. Pat. No. 3,579,980, dated 25 May 1971, C. G. Redshaw, "Rotary Stirling Engine," U.S. Pat. No. 3,984, 981, dated 12 Oct. 1976, M. Shuman, "Double Piston Engine," U.S. Pat. No. 3,583,155, dated 8 June 1971 and "Oscillating Piston Apparatus," U.S. Pat. No. 3,807,904, dated 18 Feb. 1974 and continuation U.S. Pat. No. 3,899,888, dated 19 Aug. 1975, G. A. P. Andman, et al, "Hot-Gas Reciprocating Engine," Netherlands Pat. No. 7,212,380, dated 13 Sept. 1972 and U.S. Pat. No. 3,854,290, dated 17 Dec. 1973, J. Cloup, "Isothermal Chamber and Heat Engines Constructed Using Said Chamber," France Pat. No. 7,804,308, dated 15 Feb. 1978 and U.S. Pat. No. 4,285,197, dated 25 Aug. 1981, A. A. Keller, et al, "Reciprocating Piston Engine Specifically Hot Gas Engine or Compression," Federal Republic of Germany Pat. No. 2,736,472, dated 12 Aug. 1977 and U.S. Pat. No. 4,271,669, dated 9 June 1981.

Finally no citing of Stirling Cycle hot gas engine development could be complete without listing the 500 plus page work "Stirling Engines" written by Graham Walker and published by Oxford University Press, 1980.

In the majority of hot gas engine embodiments heating and cooling of the working gas takes place outside the cylinders. Thus, the working gas contained in the volumes swept by the power pistons does not get properly heated during expansion nor properly cooled during compression. Hence, the actual cycle in these embodiments is different from either the Stirling or Ericsson engine cycles and they cannot achieve Carnot efficiency.

There are improved hot gas engines where the heating and cooling regions are incorporated within the cylinder volumes swept by the power pistons. However the piston motion in these engine embodiments is continuous. The continuous piston motion causes portions of the working gas to continuously cross over from the heating cylinder to the cooling cylinder while gas expansion is in progress. The fraction of the gas that crosses over is a function of the compression ratio and increases as the compression ratio is increased. A similar crossover takes place between the heating and cooling cylinders during the gas compression step. It can be shown that the gas present in the cooling cylinder during each instant the expansion is in progress and the gas present in the heating cylinder during each instant the compression is in progress produce negative work cycles that reduce the thermal efficiency of the engine from the Carnot efficiency.

It is therefore desirable to provide a hot-gas engine in which its operating cycle thermal efficiency is maximized by:

- ensuring that virtually all of the working gas is contained within the heating cylinder during expansion;
- ensuring that virtually all of the working gas is contained within the cooling cylinder during compression;
- ensuring that isobaric working gas transfer between the paired cylinders is optimized by providing a working gas volume in the heating cylinder which is greater than the corresponding volume in the cooling cylinder, the volume ratio being in the same ratio as the absolute temperatures of their respective isothermal processes;
- ensuring that isobaric working gas transfer between the paired cylinders is optimized by making the ratio of the rate of decrease of gas volume in the sending cylinder to the rate of increase of gas volume in the receiving cylinder equal to the ratio of the absolute temperature of their respective isothermal processes.

The thermal efficiency of the invention hot-gas Ericsson cycle engine, disclosed herein, is maximized by incorporating means to accomplish the above requirements.

SUMMARY OF THE INVENTION

The proposed invention embodiments consist of heating and cooling cylinders, operated in pairs, wherein heating and cooling zones are provided within the volumes swept by their respective power pistons. They differ from prior art engines in that the piston in the cooling cylinder remains at top dead center throughout the duration of the expansion step in the heating cylinder; and the piston in the heating cylinder remains at top dead center throughout the duration of the compression step in the cooling cylinder. Hence, the working gas is virtually all in the heating cylinder during the entire expansion step and virtually all in the cooling cylinder during the entire compression step.

The isochoric step of the Stirling cycle engine cannot be performed when the working gas has to be transferred from the cooling cylinder, at the lower pressure, to the heating cylinder, at a higher pressure. However, assuming frictionless, reversible flow between the two cylinders the isobaric steps of the Ericsson cycle are possible. Hence the disclosed invention embodiments utilize the Ericsson cycle instead of the Stirling cycle. Accordingly the volumes of the heating and cooling cylinders are selected to be in the same ratio as the absolute temperatures of their isothermal processes. Isobaric transfer of the working gas mass between cylinders is achieved by making the ratio of the rate of gas volume decrease in the sending cylinder to the rate of gas volume increase in the receiving cylinder equal to the ratio of the absolute temperatures of their respective isothermal processes.

BRIEF DESCRIPTION OF THE FIGURES

The invention may be best understood by reference to the detailed description of specific embodiments in conjunction with the accompanying figures, in which.

Figure 1:
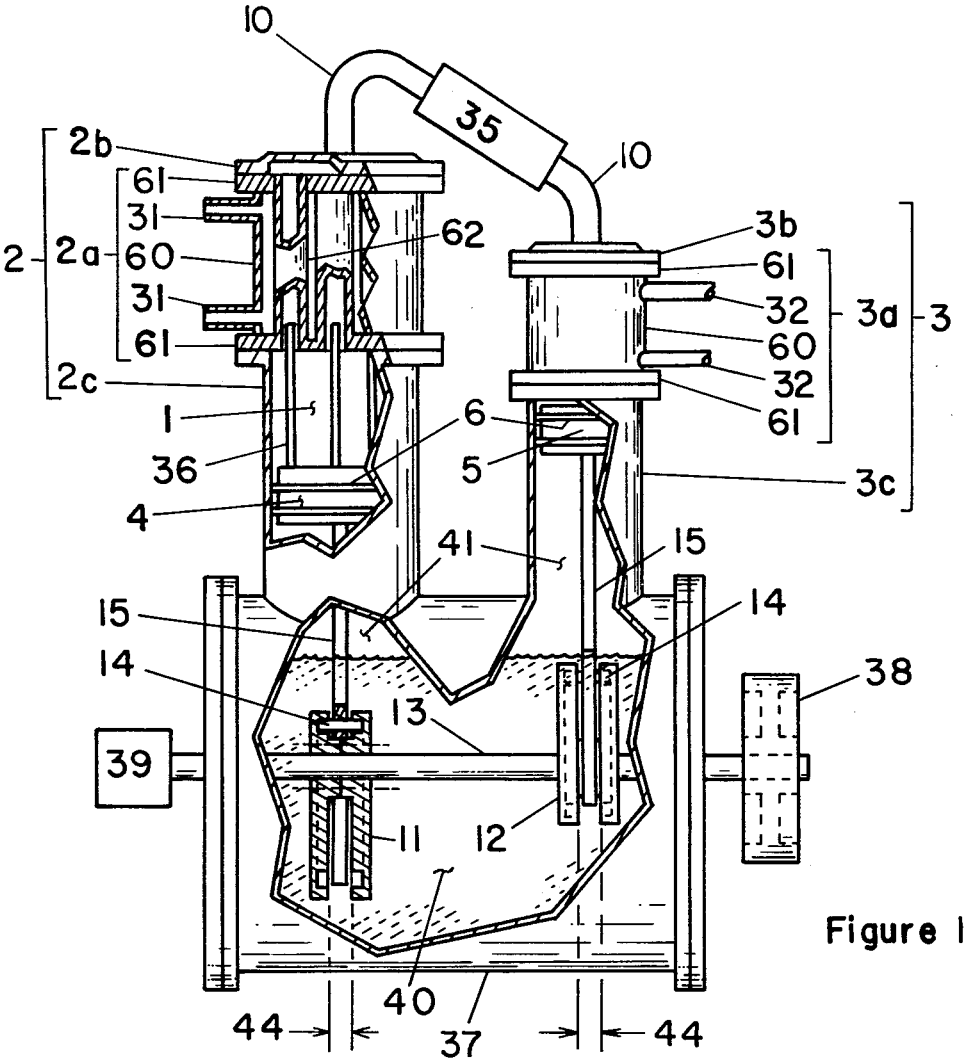
FIG. 1 is an elevation view of a solid piston, mechanically driven, hot gas engine whose operation is controlled by specially shaped and mounted cams as illustrated in FIGS. II and III.
Figure 11:
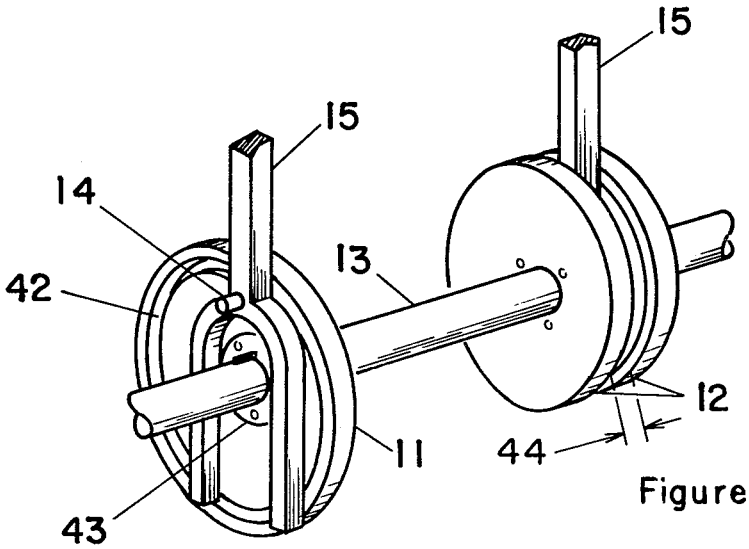

FIG. II is an isometric view showing the herein described specially shaped cams, cam followers, reciprocating means and general construction of the cams mounted and fixed onto a common drive shaft;

FIG. III illustrates the special relative angular displacement between the two cams. Each cam is shown in outline only and is a simultaneous elevation view of the two cams. The cams are shown side by side, instead of one in front of the other, solely for the sake of clarity;

FIG. IV is an elevation, single line, schematic view of a liquid piston, mechanically driven, hot gas engine whose operation is controlled by the cams described in FIGS. II and III;

FIG. V is an elevation, single line, schematic view of a herein described liquid piston, hydraulically driven, hot gas engine whose operation is controlled by liquid-level sensing-switch operated valves in the working gas flow path between the two cylinders; and, FIG. VI is a diagram of the Ericsson cycle depicted on a pressure-volume (p-v) plot. The invention p-v diagram is identical to the Ericsson cycle wherein the working gas process steps are: 1 to 2 is isothermal expansion at Tmax; 2 to 3 is isobaric transfer between cylinders with heat storage in the regenerator; 3 to 4 is isothermal compression at Tmin; and, 4 to 1 , to complete one cycle is isobaric transfer between cylinders with heat recovery from the regenerator.

DETAILED DESCRIPTION OF THE INVENTION EMBODIMENTS

FIG. I of the drawings shows a mechanically driven engine with solid pistons. Among the primary interest components are a heating cylinder (2) and a cooling cylinder (3), each made up of upper heat exchanger part (*2a*) and (*3a*), with flanged flat lid part (*2b*) and (*3b*) and a lower part (*2c*) and (*3c*).

The upper heat exchanger parts (*2a*) and (*3a*) consist of a cylindrical shell (60) fluid seal connected at either end to tube sheets (61) similar to those in a fixed tube sheet heat exchanger. The portions of tube sheets (61) projecting radially beyond shell (60) form the flanges to which are bolted lower parts (*2c*) and (*3c*), below, and flat lid parts (*2b*) and (*3b*), above. Inside each cylindrical shell (60), with axes parallel to each other and that of the shell (60), is a dense population of heat transfer tubes (62) with just sufficient spacing between them to permit circulation of the heating or cooling medium. The heat transfer tubes (62) are all approximately the same length as the shell (60) of the upper heat exchanger part (*2a*) and (*3a*) and are fluid seal connected at their ends along their outer circumferential edges to the inside edges of matching holes in the tube sheets (61). The shells (60) of upper heat exchanger parts (*2a*) and (*3a*) each have two nozzle openings (31) and (32), respectively, for introduction and removal of the heating and cooling fluids.

The lower parts (*2c*) and (*3c*) consist of cylindrical shells having approximately the same length and diameter as the cylindrical shells (60) of their counterpart upper heat exchanger parts (*2a*) and (*3a*), respectively. The cylindrical shells of lower part (*2c*) and (*3c*) are seal connected at their upper ends along their outer circumference edges to flanges which match the flanges of the lower tube sheets (61), of upper heat exchanger parts (*2a*) and (*3a*). At their lower ends the cylindrical shells of lower parts (*2c*) and (*3c*) are fluid-seal connected in a vertical in-line fashion onto a horizontal fluid-sealed casing shell (37). Upper heat exchanger parts (*2a*) and (*3a*) are flange seal connected at the upper end of lower parts (*2c*) and (*3c*), respectively. The flat lids (*2b*) and (*3b*) are flange seal connected to the upper ends of upper heat exchanger parts (*2a*) and (*3a*), respectively, to complete the assemblies of the heating (2) and cooling (3) cylinders, respectively. The flat lids (*2b*) and (*3b*) are connected to each other through a fluid sealed gas flow path (10) which serially incorporates a heat regenerator (35).

In the heating (2) and cooling (3) cylinders are solid pistons (4) and (5), each with at least one ring seal (6). Each piston, (4) and (5), has as many rod-like male projections (36) as there are mating tubes (62) in its counterpart upper heat exchanger part (*2a*) and (*3a*). The rod-like male projections (36) are approximately the same length as the tubes (62) and have as large a diameter as possible while still permitting the working gas (1) to flow between the rod-like male projections (36) and the inner surfaces of the tubes (62) during piston motion. The pistons (4) and (5) are connected by connecting rod means (15) and low-friction cam followers (14) to their respective dynamically balanced heating (11) and cooling (12) cams. Said cams (11) and (12) are rigidly mounted on and keyed to a common shaft (13) which is fluid seal, low friction, rotatably mounted onto the end plates of casing (37). Also mounted on shaft (13) are flywheel and power take off means (38) and a starter motor (39).

The balanced cams (11) and (12), typical lobes, and their special relative to each other angular positioning on shaft (13) shown further in FIGS. II and III and described in greater detail therein. Lobed cams are illustrated in the drawings because of their simplicity.

However, other means of imparting equivalent reciprocating motion to connecting rods (15) are indeed possible without the use of said dynamically balanced lobed cams (11) and (12). An alternate method could provide independent differential servo-motor drive to each connecting rod (15) to reciprocate in heating and cooling cylinders (2) and (3) wherein the drive could be electric, hydraulic or pneumatic under computer control. The action of the cams (11) and (12) through their cam followers (14), and connecting rods (15), is to cause pistons (4) and (5) to have reciprocating motion in their respective cylinders (2) and (3). At their respective top dead centers (TDC) the upper surfaces of pistons (4) and (5) come as close as possible but do not touch the lower tube sheets (61) in upper heat exchanger parts (2*a*) and (3*a*) respectively. At the TDC position the male rod-like projections (36) are fully inserted into their respective mating tubes (62). At bottom dead center (BDC) the top of the male rod-like projections (36) come as close as possible but do not withdraw completely from their mating tubes (62). The ring seals (6) of pistons (4) and (5) are at all times in contact with the inside surfaces of lower parts (2*c*) and (3*c*) respectively, which are smoothened to provide a good seal. Enclosed in cylinders (2) and (3) above the sealing rings (6) of their respective pistons is the working gas (1) which may be prepressurized for greater power output. Casing (37) is filled with nonvolatile, inert lubricating oil (40) to a level slightly above shaft (13). Above the free surface of casing lubricating oil (40) and below the sealing rings (6) of pistons (4) and (5), is casing gas (41) which has the same chemical composition and is prepressurized to the same pressure as the working gas (1). The casing gas (41) does not take part in the engine cycle; however, it keeps the working gas (1), above the ring seals (61), from leaking past said rings (6) and being lost when the engine is not in operation.

FIG. II illustrates the construction of the cams (11) and (12), cam followers (14), and connecting rod (15). The cam followers (14) are sturdy, short, pin-like projections mounted at right angle from the reciprocating means (15) engaging the grooves (42) in each half of the cams (11) and (12). The cams (11) and (12) are fabricated in two opposite-hand identical halves and bolted together along their central circular portions (43) where the cam section is thicker than the rest of the cam. The radius of the central circular portion (43) is less than the minimum cam groove (42) radius. The forked clevis portion of the connecting rod (15) straddles the central circular portion(43). The additional thickness of the central circular portion (43) provides the gap (44) between the two halves of the assembled cam (11) and (12), into which the lower clevis portion of the connecting rod (15) can slip with cam follower pins (14) positioned into grooves (42), without binding against the inside surfaces of the two portions of the cam at gap (44). The inner distance between the legs of the clevis fork of connecting rods (15) is such that it is slightly larger than the diameter of the central thicker circular portion (43). This permits said clevis forks, and hence the connecting rods (15) and pistons (4) and (5), to slide up and down without binding on the thicker central portion (43). The numbers 1, 2, 3 and 4 on the cams (11) and (12) refer to the end points of the process steps involved with the Ericsson cycle (FIG. VI) and are related to the shape of the active cam surface, i.e., the path followed by the cam follower (14) if the cam were considered to be stationary and the connecting rod (15) with the cam followers (14) were rotated.

FIG. III shows simultaneous elevation views of the active cam surfaces of the heating (11) and cooling (12) cams. Instead of being shown one behind the other, as a normal elevation view would be, the cams are shown side by side for purposes of clarity. A simultaneous view means that any pair of points, one on each cam (11) and (12), in the same direction from shaft (13) would be contacting their respective cam followers (14) simultaneously assuming in-line arrangement of the cylinders (2) and (3) on casing (37). Since points 1, 2, 3 and 4 on the heating cam (11) contact the heating cam follower (14) simultaneously when points 1, 2, 3 and 4 on the cooling cam (12) contact the cooling cam follower (14), each pair of points is in the same direction form the shaft (13).

The heating cam (11) has its minimum radius at point 2 and its maximum radius between points 3 and 4. The cooling cam (12) has its minimum radius at 3 and its maximum radius between points 1 and 2. Point 1 on the heating cam (11) corresponds to point 1 on the cooling cam (12), i.e., it is the point on the heating cam (11) when the isothermal gas expansion step starts because the cooling cam (12) has just caused its piston(5) to reach TDC. It is important to note the direction of rotation marked on the FIG. III cams (11) and (12). Point 4 on the cooling cam (12) corresponds to point 4 on the heating cam (11); i.e., it is the point on the cooling cam (12) when the isothermal gas compression step stops because the heating cam (11) causes its piston (4) to start descending from TDC. At this time the isobaric step 4 to 1 starts as the compressed working gas (1) is transferred from the cooling cylinder (3) to the heating cylinder (2). Design of cams (11) and (12) depends upon the cross-sectional area actually occupied by the working gas (1) inside the cylinders (2) and (3). The maximum radius minus the minimum radius of a cam is the stroke length of the piston controlled by that cam. Stroke length times the actual average, active, cross-sectional area of the working gas (1) is the working volume of that cylinder.

The cam stroke lengths are selected in conjunction with their respective pistons and cylinders such that the working volumes of their cylinders are in the same ratio as the absolute temperatures of their respective isothermal processes. In addition the shapes of the cams (11) and (12), in the regions 2 to 3 and 4 to 1 are so matched along each point in conjunction with their respective pistons and cylinders that the rate of volume decrease in the sending cylinder and the rate of volume increse in the receiving cylinder at each instant are in the ratio of the absolute temperatures of their respective isothermal processes.

FIG. IV is a schematic illustration of a mechanical embodiment version of the present invention with liquid pistons (7) and (8). The operative elements consist of a heating cylinder (2) for heating the working gas (1), and a cooling cylinder (3) for cooling the working gas (1). The heating (2) and cooling (3) cylinders are essentially vertical heat exchangers and are seal connected to each other at the upper ends of their working gas sides through a fluid sealed gas flow path (10) which serially incorporates a heat regenerator (35). At their lower ends the working gas sides of the heating (2) and cooling (3) cylinders are connected by fluid sealed paths (70) to flanged chambers (22) and (23), each of increased cross sectional area comprising two approximately equal upper (22*a*), (23*a*) and lower (22*b*), (23*b*) parts and flexible heat insulating diaphragm (22*c*) and (23*c*). The heating fluid side of heating cylinder (2) is provided with ports (31) for the introduction and removal of the heating medium. The cooling fluid side of cooling cylinder (3) is provided with ports (32) for the introduction and removal of the cooling medium. In FIG. IV, and again in FIG. V, the heating and cooling fluids at (31) and (32) are shown on the tube side with the working gas (1) to be heated and cooled shown on the shell side. There is no restriction intended on the type of heat exchangers used; whether the heating and cooling mediums are on the shell side or the tube side depends upon the specific heating or cooling sources used and the specific application.

A non-volatile, inert liquid (71) of low viscosity is contained in portions of cylinders (2) and (3)and upper portions (22*a*) and (23*a*) of flanged chambers (22) and (23) above diaphragms (22*c*) and (23*a*). The piston liquid (71) on the heating cylinder (2) side does not have to be the same as the piston liquid used on the cooling cylinder (3) side. The free surface of the piston liquid in the cylinders (2) and (3) from liquid pistons (7) and (8) that seal against the working gas (1) by forming a fluid seal (9) against the inside surface of the working gas side of heating (2) and cooling (3) cylinders.

The quantity of liquid in the heating or cooling cylinders (2) and (3), paths (70) and flanged chambers (22) and (23) is such that with diaphragms (22*c*) or (23*c*) flexed to their lowest position the free surface of the liquid pistons (7) or (8) is at or slightly above the lower edges of the heat transfer surfaces in cylinders (2) or (3), respectively; and, with diaphragms (22*c*) or (23*c*) flexed to their highest position the free surface of liquid pistons (7) and (8) are at or slightly below the upper edges of the heat transfer surfaces in cylinders (2) and (3), respectively. Enclosed in the working gas sides of cylinders (2) and (3), above their respective liquid pistons (7) and (8) and bounded by the walls of the fluid sealed flow path (10) and regenerator (35), is an inert, noncondensing, low viscosity working gas (1), which may be prepressurized for greater engine power output.

The lower portions (22*b*) and (23*b*) of flanged chambers (22) and (23) are fluid seal connected to the engine casing (37). The diaphragms (22*c*) and (23*c*) are connected at (22*d*) and (23*d*) to reciprocating connecting rods (15) and low-friction cam followers (14) to their respective heating and cooling cams (11) and (12) that are rigidly mounted onto shaft (13), which is fluid seal and rotatably mounted onto the end plates of casing (37). Also mounted on (13) are flywheel and power take off means (38) and a starter motor (39), shown at opposite shaft ends only for clarity. Casing (37) is filled with a non-volatile, inert, lubricating oil (40) to a level slightly above shaft (13). Above the free surface of the oil (40) but below diaphragms (22*c*) and (23*c*) is an inert, low viscosity gas (41) prepressurized to the same pressure as the working gas (1). The prepressurization of the gas (41) reduces the magnitude of forces across diaphragms (22*c*) and (23*c*).

The cams (11) and (12) and their special relative to each other angular positioning, on shaft (13) are shown in FIGS. II and III and are already described in detail above. The action of cams (11) and (12) through cam followers (14) and connecting rods (15) is to cause the diaphragms (22*c*) and (23*c*) and the liquid pistons (7) and (8) to experience reciprocating motion. When the maximum radius portion of the cam (11) or (12) contacts the cam follower (14) the respective diaphragm (22*c*) or (23*c*) is caused to flex to its extreme upward position; when the minimum radius point of the cam (11) or (12) contacts the cam follower (14) the respective diaphragm (22*c*) or (23*c*) is caused to flex to its extreme downward position. With the diaphragm (22*c*) or (23*c*) flexed to the extreme upward position the respective liquid piston (7) or (8) is at TDC; with the diaphragm (22*c*) and (23*c*) flexed to the extreme downward position the respective liquid piston (7) or (8) is at BDC.

FIG. V of the drawings illustrates a hydraulic embodiment version of the present invention with liquid pistons (7) and (8). The different components of the engine are shown in the same schematic form as used in FIG. IV. The engine components (2), (3), (10), (35), (22), (22*a*), (22*b*), (22*c*), (23), (23*a*), (23*b*), (23*c*) (31), (32), (7), (8), (9) and the nonvolatile inert liquid (71), contained in the working gas sides of cylinders (2) and (3) and those portions of flanged chamber (22) and (23)above diaphragms (22*c*) and (23*c*) are the same as those already described for FIG. IV above.

In FIG. V fluid sealed flow path (10) connecting the upperends of heating and cooling cylinders (2) and (3) is provided wtih electrically operated mechanical valves (V16) and (V17)positioned adjacent to cylinders (2) and (3) respectively. Valves (V16) and (V17)are operated by liquid level switches (H1) and (C2), (C1) and (H2), respectively. Switches (H1) and (H2) are positioned on the heating cylinder (2); (H1) located at the upper end and (H2) at the lower end. Switch (H1) is designed to produce an electrical signal when it is contacted by the surface of liquid piston (7) rising from below which operates valve (V16) from open to closed. Switch (H2) is designed to produce an electrical signal when contacted by the surface of liquid piston (7) descending from above which operates valve (V17) from closed to open. Liquid level switches (C1) and (C2) are positioned on the cooling cylinder (3); switch (C1) positioned at the upper end and switch (C2) positioned at an intermediate location, which determines the compression ratio of the engine. Moving the location of switch (C2) up would increase engine compression ratio, moving it down would decrease engine compression ratio. Switch (C1) is designed to produce an electrical signal when it is contacted by the surface of liquid piston (8) rising from below which operates valve (V17) from open to closed. Switch (C2) is designed to produce an electrical signal when contacted by the surface of liquid piston (8) rising from below to operate valve (V16) from closed to open.

The lower sections (22*b*) and (23*b*) of flanged chambers (22) and (23) are connected to each other through a fluid sealed path (45) in which are serially included an inline pump (46) and a flow transmitter (FT-1) which supplies path (45) flow rate information to computer (C). Side path (47), in which is serially included power absorbtion means (50), connects path (45) to the lower end of the vertical stem (25*a*) of a bounce chamber (25) which includes bulb (25*b*). Bulb (25*b*) is fluid sealed to the upper end of stem (25*a*). An inert power absorption liquid (51) fills the lower sections (22*b*) and (23*b*) of flanged chambers (22) and (23), below diaphragms (22*c*) and (23*c*), paths (45) and (47) and a portion of stem (25*a*) of bounce chamber (25). Above the liquid free surface (52) of the inert liquid (51) in stem (25*a*), bounded by the inner surface of bulb (25*b*) is an inert, noncondensible bounce gas (53) which is prepressurized to match the prepressurization of working gas (1) in heating and cooling cylinders (2)and (3). Side path (47) is provided with a flow transmitter (FT-2) which supplies path (47) flow rate information to computer (C).

Power absorbtion means (50) is designed to absorb power from the inert liquid (51), flowing in either direction. The absorbed energy is stored in storage means (26). The rate of power absorbtion and the accompanying resistance flow of liquid (51) through power absorber (50) are controlled by computer (C). One possible design for power absorbtion means would be analogus to a magnetic flow meter. However, whereas a magnetic flow meter is designed for negligible power absorption, the flow path and field coils in power absorber (50) would be designed specially for large power absorption. Inline pump (46), on path (45), is similar in design to power absorber (50); however, power absorber (50) operates as a power generator while inline pump (46) operates as a power user. Pump (46) utilizes a portion of the power absorbed in absorber (50) and stored in power storage means (26) to pump the liquid (51) between lower flange sections (22*b*) and (23*b*) to flex their respective diaphragm (22*c*) and (23*c*) up and down.

The numbers 1 , 2 , 3 , and 4 adjacent to the heating cylinder (2) the cooling cylinder (3) and stem (25*a*) of bounce chamber (25) correspond to the process points of state of the working gas (1) undergoing the Ericsson cycle, shown in FIG. VI. When the working gas (1) is at a given process point of state the liquid level surface of piston (7) in cylinder (2), piston (8) in cylinder (3) and level (52) in stem (25*a*) are at the same process state. Valve (V18), positioned serially in side path (47), is controlled by the engine start/stop switch (100). It is noted that the active part of a second hot-gas engine, comprising the regenerator (35), gas path (10), heating and cooling cylinders (2) and (3), down to the junction of the fluid-sealed path (45) at side path (47)could replace the bounce chamber (25) and its bounce gas (53) at its junction with side path (47) above engine start-stop valve (V18). The bounce chamber or a second engine operating 180° out of phase with the first engine is a reset mechanism for cyclic repetition. Overall components and operation of the added second engine will be identical to the hot gas engine disclosed and described herein.

FIG. VI shows the Ericsson cycle on a pressure-volume (p-v) plot. Cycle processes 1 to 2 and 3 to 4 are isothermal process steps on the p-v plot; 1 to 2 being at the maximum operating temperature, Tmax, and 3 to 4 being at the minimum operating temperature, Tmin. Process step 1 to 2 is performed in the heating cylinder (2) and 3 to 4 is performed in the cooling cylinder (3). Process steps 4 to 1 and 2 to 3 are isobaric heat addition and heat removal processes that are accomplished during the transfer of the working gas (1) between the cylinders (2) and (3) through the flow path (10) and regenerator (35).

DETAILED DESCRIPTION OF THE PREFERRED EMBODIMENT

The detailed operation of the three embodiments are presented in this section. There is no preferred embodiment since each is best suited for a different application; thus, any one of the embodiments is not preferred over another.

The FIG. 1 embodiment would be best used in a high revolution per minute (RPM) mobile engine application. The FIG. IV and FIG. V embodiments would be best suited for low speed engines for stationary power generation. The FIG. I and FIG. IV embodiments require temperature differences in the range of 400° to 1200° F. between isothermal process temperatures Tmax and Tmin. The FIG. V embodiment is able to operate with extremely low temperature differences, in the order of 25° F. between Tmax and Tmin due to the extremely low frictional losses inside the engine components.

OPERATION

In FIG. 1 mechanical embodiment the pistons (4) and (5) are moved between top dead center (TDC) and bottom dead center (BDC) by the action of their cam (11) or (12) cam follower (14) and connecting rod (15). When either piston (4) or (5) is at TDC no working gas (1) is present in the respective cylinder (2) or (3). The special shapes of the cams (11) and (12) and their relative angular positioning with respect ot each other (FIGS. II and III), preserved by rigid attachment means onto common shaft (13), causes the working gas (1) in each pair of cylinders to undergo the process steps of the Ericsson Cycle (FIG. VI) as the shaft (13) rotates.

FIGS. II and III illustrate the rotation direction of shaft (13), the special cam (11) and (12) shapes and their fixed relative angular mounting onto the common shaft (13). Encircled numbers 1 , 2 , 3 , and 4 are points in FIGS. II and III on the cam (11) and (12) surfaces; they relate to the process points of the Ericsson Cycle pressure-volume diagram of FIG. VI. When the cam followers (14) contact cam points 1 the cooling cam (12) has just rotated to the point where its cam radius has increased to its maximum value, which it maintains during the rotation of the shaft (13) from 1 to 2 . Simultaneously, while the cooling cam (12) rotates from 1 to 2 , the heating cam (11) radius decreases from its value at point 1 to its minimum value at point 2 . Since the cooling cam (12) at maximum radius keeps piston (5) at TDC in cylinder (3), through the rotation of the shaft from 1 to 2 , no working gas (1) is present in the cooling cylinder (3) during that time interval. Thus, the working gas (1) is virtually all in the heating cylinder (2) undergoing the expansion process step 1 to 2 , as piston (4) descends from its position at 1 to BDC at 2 . The expanding working gas (1) in heating cylinder (2) occupies the space in the heat transfer tubes (62) vacated by rod-like projections (36); and flows through the gaps between the inner surfaces of heat transfer tubes (62) and rod-like projections (36) into the space in lower part (2*c*) of cylinder (2) above piston (4). During the expansion process step, 1 to 2 the working gas (1) has a tendency to cool as it performs work on piston (4); however, it is not permitting to cool because heat is constantly supplied to the working gas (1) through the surfaces of heat transfer tubes (62) and from the heating surfaces of rod-like projections (36) which were heated during process step 3 to 4 of the previous cycle when they were in full-length proximate contact with the heat transfer tubes (62). The heat to tubes (62) in upper heat exchanger part (2*a*), is supplied by heating media flow through ports (31). The work performed on piston (4) by working gas (1) in process step 1 to 2 is transmitted to flywheel and power takeoff means (38) through connecting rod (15), cam follower (14), cam (11), and shaft (13).

At process point 2 the heating piston (4) is at BDC and the cooling piston (5) is at TDC. As shaft (13) continues rotating the heating cam (11) radius increases and the cooling cam (12) radius decreases. This causes the heating cylinder piston (4) to rise from BDC and the cooling cylinder piston (5) to descend from TDC; thus, transferring the expanded working gas (1) from the heating cylinder (2) to the cooling cylinder (3) through the flow path (10) which includes the regenerator (35). As the cooling cylinder piston (5) descends from TDC in cooling cylinder (3) the working gas (1) occupies the space in heat exchanger tubes (62) vacated by rod-like projections (36) and flowing through the inner surface gaps between them into the space in lower part (3*c*) of cooling cylinder (3) above piston (5). The working gas (1) exiting the heating cylinder (2) at temperature Tmax flows through path (10), deposits heat in the regenerator (35) and enters the cooling cylinder (3) at temperature Tmin. The cam (11) and (12) surfaces between points 2 and 3 , and the cross-section areas occupied by the working gas (1) in the heating cylinder (2) and the cooling cylinder (3) are chosen so that during process step 2 to 3 the rate of working gas (1) volume increase in the cooling cylinder (3) and the rate of working gas (1) volume decrease in the heating cylinder (2) are in the same ratio as the respective absolute temperatures Tmin and Tmax of their isothermal process steps 3 to 4 in cooling cylinder (3) and 1 to 2 in heating cylinder (2). This permits the working gas (1) transfer step 2 to 3 from the heating cylinder (2) to the cooling cylinder (3) to take place isobarically, assuming a near ideal case where working gas (1) transfer frictional losses can be neglected. Thus, at point 3 the completion of transfer step 2 to 3 , the heating cylinder piston (4) will be at TDC and the cooling cylinder pistion (5) will be at BDC.

As the shaft (13) rotation continues towards point 4 the heating cylinder piston (4) remains at TDC since cam (11) radius remains maximum allowing virtually no working gas (1) to be present in the heating cylinder (2); simultaneously, the cooling cam (12) radius increases causing the cooling cylinder piston (5) to rise from BDC to its position at point 4 thereby achieving compression of the working gas (1) in cooling cylinder (3). During this compression process step 3 to 4 the heat of compression is removed through the surfaces of heat exchanger tubes (62) and the surfaces of rod-like projections (36) to keep the compression process step 3 to 4 isothermal at Tmin. The rod-like projections (36) on piston (5) were cooled during step 1 to 2 of the previous cycle when they were in full length proximate contact with tubes (62). The cooling to heat exchanger tubes (62) is supplied by cooling media flow through ports (32). During isothermal compression step 3 to 4 in cylinder (3) piston (5) performs work on working gas (1). The energy to perform this work is supplied by flywheel (38) through shaft (13), cam (12), cam follower (14), and connecting rod (15). However, the work performed by piston (5) on working gas (1) during the isothermal compression step 3 to 4 is less than the work performed by the working gas (1) on piston (4) during the isothermal expansion step 1 to 2 ; hence, there is a net positive output of energy from the engine.

At point 4 the heating cylinder piston (4) starts descending from TDC while the cooling cylinder piston (5) continues to ascend to its TDC; thus, resulting in transfer of the compressed working gas (1) from the cooling cylinder (3) to the heating cyliner (2). The working gas (1) exiting the cooling cylinder (3) at temperature Tmin flows through path (10) picks up the heat deposited during earlier process step 2 to 3 as it passes through regenerator (35) and enters the heating cylinder (2) at temperature Tmax. The cam (11) and (12) surfaces and the cross section areas occupied by the working gas (1) in cylinders (2) and (3) are chosen to that during process step 4 to 1 the rate of working gas (1) volume increase in the heating cylinder (2) and the rate of working gas (1) volume decrease in the cooling cylinder (3) are in the same ratio as the respective absolute temperatures, Tmax and Tmin, of their respective isothermal process steps 1 to 2 in cylinder (2) and 3 to 4 in cylinder (3). This permits the working gas (1) transfer step 4 to 1 from the cooling cylinder (3) into the heating cylinder (2) to take place isobarically, assuming a near ideal case where working gas (1) frictional losses can be neglected.

It must be mentioned that the gas (41), enclosed in the casing (37) above the surface of the lubricating oil (40), could experience cyclic pressure/volume changes resulting in some opposition to engine motion. This effect is overcome by operating engines in pairs, i.e., in increments of four cylinders, two cylinders per engine, on the same drive shaft (13) and casing (37) with the two engines of each pair operating 180 degrees out of phase with each other. Another alternative is to make the volume of the gas (41) in the casing (37) large with respect to its volume changes thus making pressure variations negligible.

To start the FIG. I engine operation the heating and cooling media are applied through ports (31) and (32) to heating and cooling cylinders (2) and (3), respectively, and shaft (13) is rotated by the starter motor (39). To stop the engine the heating and/or cooling media flow are cut off.

The operation of the liquid/mechanical engine in the FIG. IV embodiment is similar to that of the FIG. I mechanical engine. The Ericsson cycle process steps (FIG. VI) are performed in the FIG. IV engine due to the special cam (11) and (12) shapes and their special angular relative positioning with respect to each other on shaft (13) as shaft (13) rotates in the same way as in the FIG. I engine. However, in the FIG. IV engine the connecting rods (15) connect at their upper ends to diaphragms (22*c*) and (23*c*) at connection points (22*d*) and (23*d*) instead of to solid pistons (4) and (5), respectively, as in the FIG. I engine. The vertical displacement position of diaphragm (22*c*) and (23*c*) and liquid piston (7) and (8) will depend upon the position of cam follower (14) along cam (11) and (12) surface. Hence, the operation of the FIG. IV engine will read similar to the operation of the FIG. I engine except that instead of solid pistons (4) and (5) being at TDC, BDC, or positions in between, their place is taken by liquid pistons (7) and (8), respectively. Also, the FIG. IV liquid/mechanical engine heating (2) and cooling (3) cylinder construction is different from that of heating (2) and cooling (3) cylinder construction respectively of FIG. I mechanical engine. The FIG. IV liquid/mechanical engine does not have cylinder upper heat exchanger parts (2*a*) and (3*a*), or flat lid (2*b*) and (3*b*), or lower parts (2*c*) and (3*c*); instead, the working gas (1) is heated in heat exchanger heating cylinder (2) and cooled in heat exchanger cooling cylinder (3).

Bearing in mind the above mentioned differences the operation of FIG. IV engine is the same as that of FIG. I engine in every aspect including the method for starting and stopping the engine.

In FIG. V engine the liquid pistons (7) and (8) in cylinders (2) and (3), respectively, are maintained at their TDC positions by the closing of valves (V16) or (V17), respectively. The circled numbers 1, 2, 3, and 4 next to cylinders (2) and (3) and stem (25*a*) of the bounce chamber (25) indicate the positions of liquid pistons (7), (8), and liquid free surface (52), respectively, when the working gas (1) is performing the steps of the Ericsson cycle related to the circled process points of state 1, 2, 3 and 4 of working gas (1) on FIG. VI.

At point 1 the position of piston (8) in cooling cylinder (3) is at TDC and is maintained there as long as valve (V17) remains closed. The expansion process step 1 to 2 is accomplished in cylinder (2) by piston (7) as it descends from its position at point 1 to point 2. The liquid expelled from cylinder (2) causes diaphragm (22*c*) to flex downwards displacing liquid (51) through side path (47) and power absorber (50) into stem (25*a*) raising the position of liquid free surface (52) from 1 to 2. During this expansion process step 1 to 2 no working gas (1) is present in cylinder (3) because piston (8) is maintained at TDC by valve (V17) which remains closed. Also during expansion process step 1 to 2 heat is supplied to the working gas (1) in cylinder (2) through the heat transfer surfaces in cylinder (2) by the circulation of heating fluid through ports (31), to maintain the expansion step 1 to 2 isothermal. Power absorber (50) absorbs a portion of the work produced in the isothermal expansion step 1 to 2. This energy is stored in storage means (26) or transmitted to an external load, or some combination thereof. The remaining work produced in isothermal expansion step 1 to 2 is stored in bounce gas (53) of bounce chamber (25) as the liquid free surface level rises from 1 to 2 in step (25*a*).

Process step 1 to 2 is terminated and step 2 to 3 begins when piston (7), descending from above, contacts switch (H2) which generates a signal to open valve (V17). Valve (V16) is already open, and when valve (V17) opens, process step 2 to 3 starts with the descent of liquid piston (8) in cooling cylinder (3) and the simultaneous rise of liquid piston (7) in heating cylinder (2), transfering the expanded working gas (1) from heating cylinder (2) at temperature Tmax through path (10) and serial regenerator (35) where it deposits heat, to cooling cylinder (3) at temperature Tmin. The descent of piston (8), i.e., the working gas (1) volume increase in cylinder (3) is caused by pump (46) which uses stored energy from storage means (26) to pump the liquid (51) from the lower section (23*b*) below diaphragm (23*c*) in flanged chamber (23) to the lower section (22*b*) below diaphragm (22*c*) in flanged chamber (22) on the heating side under computer (C) control. The ascent of liquid piston (7), i.e., the working gas volume decrease in heating cylinder (2) is caused by the quantity of liquid (51) transferred by pump (46) which caused the descent of piston (8) in cylinder (3) plus the quantity of liquid (51) entering the lower section (22*b*) below diaphragm (22*c*) in flanged chamber (22) on the heating side because of the simultaneous decrease in level of free liquid surface (52) in stem (25*a*) from 2 to 3 as bounce gas (53) returns some of the energy stored by it during isothermal expansion process step 1 to 2. Computer (C) adjusts the rates of liquid (51) flow from below diaphragm (23*c*) and stem (25*a*) using flow rate information supplied by flow transducers (FT-1) and (FT-2) so that the rate of working gas (1) volume decrease in heating cylinder (2) and the rate of working gas (1) volume increase in cooling cylinder (3) are in the same ratio as the absolute temperatures Tmax and Tmin of their respective isothermal processes, causing working gas (1) transfer process step 2 to 3 to be isobaric.

Process step 2 to 3 ends and step 3 and 4 begins when liquid piston (7) in cylinder (2) rising from below contacts switch (H1) which generates a signal to close valve (V16). Liquid pistion (7), in heating cylinder (2), is at point 3, its highest position and remains there as long as valve (V16) remains closed. Process step 3 to 4 takes place in cooling cylinder (3) as the liquid level in cylinder (3), i.e., liquid piston (8) rises from point 3, its lowest position, to its level at 4 where switch (C2) is positioned. The pressure of bounce gas (53) pushes free liquid surface (52) from its level at 3 in stem (25*a*) to its level at 4 causing diaphragm (23*c*) to flex upwards from its lowest position thereby causing piston (8) to rise from its level at 3 to its level at 4 in cooling cylinder (3). During process step 3 to 4 the heat of compression is removed from working gas (1) through the heat transfer surfaces of cooling cylinder (3) by cooling media circulated through ports (32), keeping the compression step 3 to 4 isothermal at Tmin. The isothermal compression step 3 to 4 ends and transfer process step 4 to 1 begins when the liquid piston (8) level in cooling cylinder (3), rising from below, contacts switch (C2) which generates a signal that opens valve (V16). The pressure of bounce gas (53), the inside cross-section area of stem (25*a*), its hydraulic elevation with respect to heating (2) and cooling (3) cylinders and the spring constants of diaphragms (22*c*) and (23*c*) are so chosen that free liquid surface (52) in stem (25*a*) reaches its lowest position at point 4 just as piston (8) reaches point 4 and switch (C2), in cooling cylinder (3).

Process step 4 to 1 starts when piston (8), in cooling cylinder (3), contacts switch (C2) sending a signal to open valve (V16), and free liquid surface (52) in stem (25*a*) reaches the lowest point 4 and starts moving up again. Process step 4 to 1 is accomplished by the level rise of piston (8) from 4 to 1 in cooling cylinder (3) with the simultaneous level descent of piston (7) from 4 to 1 in heating cylinder (2) and the rise of free liquid surface (52) from 4 to 1 in stem (25*a*). The rise in the level of piston (8) in cooling cylinder (3) is caused by serially positioned pump (46) which uses stored energy from storage means (26) to pump the inert liquid (51) from below diaphragm (22*c*) in flanged chamber (22) to below diaphragm (23*c*) in flanged chamber (23) through flow path (45). The fall in the level of liquid piston (7) in heating cylinder (2) is caused by the removal of inert liquid (51) from below diaphragm (22*c*), of flanged chamber (22), by pump (46) plus the inert liquid (51) that leaves from below diaphragm (22*c*), of flanged chamber (22) to go to stem (25*a*) via side path (47) raising the level of free liquid surface (52) from 4 to 1 in stem (25*a*). The flow of inert liquid (51) from flanged chamber (22) to stem (25*a*) through side path (47) is aided by power absorber (50) which, for this part of the cycle, is directed by computer (C) to perform as a motor instead of a generator. Computer (C) adjusts the flow rates of inert liquid (51) to below diaphragm (23*c*) of flanged chamber (23) and to stem (25*a*) based on flow rate information supplied by flow transducers (FT-1) and (FT-2), respectively, so that the rate of working gas (1) volume decrease in cooling cylinder (3) and working gas (1) volume increase in heating cylinder (2) are in the same ratio as the absolute temperatures Tmin and Tmax of their respective isothermal process steps 3 to 4 in cylinder (3) and 1 to 2 in cylinder (2), causing the working gas (1) transfer process step 4 to 11 to be isobaric. As the compressed working gas (1) flowing through path (10) passes serially positioned regenerator (35) it picks up heat that was deposited there during earlier process step 2 to 3 raising its temperature from Tmin to Tmax. Process step 4 to 1 is complete and process step 1 to 2 starts when liquid piston (8) in cooling cylinder (3) rises from below and contacts switch (C1) that generates a signal which closes valve (V17). This completes the description of one complete cycle.

To stop the engine the start/stop switch (100) is turned to the 'stop' position which tells the computer (C) to close valve (V18) at a point in the cycle when flow transmitter (FT-2) indicates that flow has stopped. Computer (C) also suppresses the signal from switch (H2) if valve (V18) is closed when level of liquid free surface (51) was at 2 in stem (25*a*), or suppresses the signal from switch (C2) if valve (V18) is closed when liquid free surface (52) was at level 4 in stem (25*a*). Note that at the instant when liquid free surface (52) is at level 2 and 4 in stem (25*a*) flow transmitter (FT-2) indicates zero flow. The heating and cooling media flow are then turned off. Hence, when the start/-stop switch is turned to the stop position: valve (V18) will close when liquid free surface (52) level is at 2 in stem (25*a*) piston (7) level in cylinder (2) will be at 2 but switch (H2) signal will be suppressed so valve (V17) will stay closed keeping piston (8) level in cylinder (3) at its highest point; or valve (V18) will close when liquid free surface (52) level is at 4 in stem (25*a*) piston (8) level in cooling cylinder (3) is at 4 but the signal from switch (C2) would be suppressed keeping valve (V16) closed and the level of piston (7) in heating cylinder (2) at its highest level.

To restart the engine the heating and cooling media are applied to the heating and cooling sides of the respective heating (2) and cooling (3) cylinders and the engine start/stop switch (100) is turned to the start position. Valve (V18) opens, the suppressed signal from switch (H2) or (C2) are permitted to pass and the engine starts operating from the point at which it was stopped. Initial engine cycles will not be performed at peak efficiency because the temperatures need to be built up in the regenerator (35); however, after temperatures have stabilized the engine will be running both at steady state as well as at peak efficiency.

COMMENTS ON HEATING AND COOLING HEAT EXCHANGER CYLINDERS

In FIGS. I and IV, the heating and cooling heat exchanger cylinders (2) and (3) are positioned on casing (37) in an in-line arrangement. This was done to simplify the description of the angular orientation of cams (11) and (12) with respect to each other; as presented in FIGS. II and III and the accompanying explanatory paragraphs. The cylinders (2) and (3) can just as well be positioned on casing (37) in a 'Vee' arrangement, however, the respective cam orientations with respect to each other would have to include the angle of the 'Vee' by which the cylinders (2) and (3) were displaced from their inline arrangement. What ever the positioning of the cylinders the design should assure that the dead void volumes in flow paths (10) connecting the heating and cooling cylinders (2) and (3) are minimized.

In FIGS. I, IV and V heating and cooling media flow is via nozzles (31) and (32) respectively. It is important to note that successful operation of the disclosed embodiments does not require nozzles. The basic heat transfer function required is to support the working gas (1) isothermal expansion 1 to 2 and isothermal compression 3 to 4 processes, as illustrated in FIG. VI, where method of implementation is dependent on the type and nature of the heat addition and heat removal sources available. What is necessary is heat addition through the heat transfer surfaces of heating cylinder (2) during working gas (1) expansion, and heat removal through the heat transfer surfaces of cooling cylinder (2) during working gas (1) compression.

An improved closed cycle hot gas engine operating on the Ericsson cycle according to the preferred mechanical, combined liquid-mechanical and liquid engine embodiments of the invention have been described. Many modifications are possible. The invention, therefore, is not to be restricted except as necessitated by prior art and as indicated by the appended claims.

What is claimed is:

1. An improved hot gas engine operating on the Ericsson cycle having at least one pair of cylinders, one cylinder of each pair being provided with means to heat, the other with means to cool a working gas confined within them, the paired cylinders being connected to each other by a fluid sealed gas flow path with serially connected heat regenerator, each cylinder being provided with a piston which reciprocates within the cylinder, a working gas confined in the volume defined by the paired cylinders, their pistons, and the fluid sealed gas flow path connecting the cylinders, wherein the improvement comprises means responsive to position and movement of each of the pistons for reciprocating the pistons so that the cooling cylinder piston remains at top dead center throughout working gas expansion in the heating cylinder, the heating cylinder piston remains at top dead center throughout working gas compression in the cooling cylinder, in between the aforementioned isothermal process steps the working gas is transferred from one cylinder to the other with the rate of working gas volume increase in the receiving cylinder and the rate of working gas volume decrease in the sending cylinder, at each instant of the working gas transfer step, being in the same ratio as the absolute temperatures of the working gas isothermal processes in the respective cylinders.

2. An improved hot gas engine operating on the Ericsson cycle having at least one pair of cylinders, one cylinder of each pair being provided with means to heat, the other with means to cool a working gas confined within them, the paired cylinders being connected to each other by a fluid sealed gas flow path with serially connected heat regenerator, each of the cyclinders being provided with a solid piston having projections on its surface, which mate nonsealably with corresponding openings in the cylinder, so that when the piston is at its top dead center position the voids in the cylinder are essentially filled by the projections on the piston, with a working gas confined in the volume defined by the paired cylinders, their pistons, and the fluid sealed gas flow path connecting the cylinders, wherein the improvement comprises:

(a) a connecting rod for each piston, one end of which is connected to the piston, the other end to a cam follower;

(b) a cam follower for each connecting rod, in contact with the active cam surface of a cam; (c) specially shaped with respect to each other paired cam means for reciprocating the connecting rods so that the cooling cylinder piston remains at top dead center throughout working gas expansion in the heating cylinder, the heating cylinder piston remains at top dead center throughout working gas compression in the cooling cylinder, in between these aforementioned process steps the working gas is transferred from one cylinder to the other with the rate of working gas volume increase in the receiving cylinder and the rate of working gas volume decrease in the sending cylinder, at each instant of the working gas transfer being in the same ratio as the absolute temperatures of the working gas isothermal processes in the respective cylinders;

(d) means to rotate the paired cams.

3. An improved hot gas engine operating on the Ericsson cycle as defined in claim 2, wherein the connecting rod end not connected to the piston comprises:

(a) a forked clevis;

(b) at least two legs of the forked clevis straddling a central circular portion of the cam;

(c) a central circular portion of the cam being along the cam axis of rotation, whereby the reciprocating motion of the connecting rod is purely translational in the direction of its piston travel.

4. An improved hot gas engine operating on the Ericsson cycle having at least one pair of cylinders, one cylinder of each pair being provided with means to heat, the other with means to cool a working gas confined within them, the paired cylinders being connected to each other by a fluid sealed gas flow path with a serially connected heat regenerator, each of the cylinders being provided with a liquid whose free surface forms a piston, with a working gas confined in the volume defined by the paired cylinders, their pistons and the fluid sealed path connecting the cylinders, wherein, the improvement comprises:

(a) a fluid sealed path from each cylinder to the peripheral edges of a flexible diaphragm;

(b) a flexible diaphragm for each cylinder, for creating a chamber of variable volume, so that the piston in the cylinder may be reciprocated by varying the quantity of the piston liquid in the cylinder;

(c) a connecting rod for each diaphragm, one end of which is connected to the diaphragm, the other end to a cam follower;

(d) a cam follower for each connecting rod, the cam follower contacting the active cam surface of a cam;

(e) specially shaped with respect to each other paired cams for reciprocating the connecting rods so that the cooling cylinder piston remains at top dead center throughout working gas expansion in the heating cylinder, the heating cylinder piston remains at top dead center throughout working gas compression in the cooling cylinder, in between these aforementioned process steps the working gas is transferred from one cylinder to the other with the rate of working gas volume increase in the receiving cylinder and the rate of working gas volume decrease in the sending cylinder, at each instant of the working gas transfer, being in the same ratio as the absolute temperatures of the working gas isothermal processes in the respective cylinders;

(f) means to rotate the paired cams.

5. An improved hot gas engine operating on the Ericsson cycle as defined in claim 4, wherein the connecting rod end not connected to the diaphragm comprises:

(a) a forked clevis;

(b) at least two legs of the forked clevis straddling a central circular portion of the cam;

(c) a central circular portion of the cam being along the cam axis of rotation, whereby the reciprocating motion of the connecting rod is purely translational in the direction of its diaphragm travel.

6. An improved hot gas engine operating on the Ericsson cycle, having at least one pair of cylinders, one cylinder of each pair being provided with means to heat, the other with means to cool a working gas confined within them, the paired cylinders being connected to each other by a fluid sealed gas flow path with serially connected heat regenerator, each of the cylinders being provided with a liquid whose free surface forms a piston, with a working gas confined in the volume defined by the paired cylinders, their pistons and the fluid sealed path connecting the cylinders, wherein the improvement comprises:

(a) paired valves in the fluid sealed gas flow path connecting the cylinders, means for retaining the heating cylinder piston at top dead center throughout working gas compression in the cooling cylinder, and the cooling cylinder piston at top dead center throughout working gas expansion in the heating cylinder;

(b) piston liquid level position and direction of motion sensing means for controlling the open/closed state of the paired valves;

(c) a fluid sealed path from each cylinder to the peripheral edges of a flexible heat insulating diaphragm;

(d) a flexible heat insulating diaphragm for each cylinder, means for creating a chamber of variable volume, so that the piston in the cylinder may be reciprocated by varying the quantity of piston liquid in the cylinder, the flexible diaphragm being heat insulating, means for minimizing heat loss from the heating cylinder to the cooling cylinder through the engine liquid components;

(e) a fluid sealed path connecting, the peripheral edges of the flexible heat insulating diaphragms of paired cylinders on the opposite sides of the diaphragms from the cylinders, to each other, the above fluid sealed path having a fluid sealed side path;

(f) a fluid sealed side path with a serially included power absorber connecting the fluid sealed path between the paired cylinder diaphragms to a reset mechanism for cyclic repetition of the engine;

(g) a continuous quantity of power absorption liquid confined by the paired cylinder diaphragms, the fluid sealed path connecting the diaphragms, the side path connecting the fluid sealed path between the diaphragms to the reset mechanism, and the power absorber;

(h) power absorption liquid flow control means to selectively return work energy to the power absorption liquid during working gas transfer between paired cylinders for reciprocation of the liquid pistons in the paired cylinders so that the rate of working gas volume increase in the receiving cylinder and the rate of working gas volume decrease in the sending cylinder are in the same ratio as the absolute temperatures of the working gas isothermal processes in the respective cylinders.

* * * * *